United States Patent [19]

Kim

[11] Patent Number: 4,903,893

[45] Date of Patent: Feb. 27, 1990

[54] AUTOMATIC DEVICE FOR CONTROLLING THE SUPPLY OF FUEL TO A HEATER

[76] Inventor: Cheol Kim, 892-68 Jaegi-Dong, Kyungdong Miju Apt. B-206, Dongdaemoon-Ku, Seoul, Rep. of Korea

[21] Appl. No.: 238,244

[22] Filed: Aug. 30, 1988

[51] Int. Cl.[4] ..... G05D 23/12; F24H 3/00

[52] U.S. Cl. ..... 236/1 A; 431/66; 126/116 A

[58] Field of Search ..... 237/1 R; 431/37, 39, 431/59, 60, 6, 62, 66; 236/1 A, 1 H, 1 EA, 1 E; 126/116 A

*Primary Examiner*—Henry Bennett

*Attorney, Agent, or Firm*—Birch, Stewart, Kolasch & Birch

[57] ABSTRACT

An automatic device for controlling the supply of fuel to a heater which includes magnetic device units operatively associated with on/off switches, respectively, and a thermostat operatively connected to the switches, whereby one of the switches is actuated to the off position by the sensing of the thermostat for a period time of a higher room temperature than a predetermined thermostat temperature. Also, upon the off position of the source of electric power, the fuel supply automatically puts out the fire.

4 Claims, 2 Drawing Sheets

AUTOMATIC DEVICE FOR CONTROLLING THE SUPPLY OF FUEL TO A HEATER

BACKGROUND OF THE INVENTION

1. Field of the Invention

The present invention relates to an automatic device for controlling the supply of fuel to a heater and more particularly, to an automatic kerosene supplying system for a kerosene heater including a magnetic device unit operatively associated with on/off switches, respectively, and a thermostat connected to one of the on/off switches, whereby one of the on/off switches is actuated as the off position by the sensing of the thermostat for a period of time for example, during a higher room temperature than a predetermined thermostat temperature. When the room temperature is equal to the predetermined thermostat temperature, the on/off switch can then be automatically released to the on position. Also, when the magnetic device unit is disconnected to the source of electric power, the on/off switches are actuated to the off position, respectively, so that the kerosene is not supplied to the kerosene heater.

2. Description of the Prior Art

In many of the heaters known in the art, the supply of fuel to a heater is controlled by manual means. Also the amount of the supplying fuel is controlled by rotating an on/off handle switch so that it is inconvenient to directly operate the handle switch by the hand. Furthermore, sometimes, it is insufficient to completely close the on/off switch by hand.

SUMMARY OF THE INVENTION

Accordingly, it is an object of the present invention to provide an improved automatic device for controlling the supply of fuel to a heater.

Another object of the present invention is to provide a fuel supplying device to a heater which can safely close one of the switches attached thereto by simple actuation of the switch. That is, the switch is automatically closed when a room temperature is higher than a predetermined thermostat temperature.

A further object of the present invention is to provide an automatic device for controlling the supply of fuel to a heater which is structured with a magnetic device operatively associated with the source of electric power so that the source of electricity is inactuated, the fuel suppling operation is automatically stopped and simultaneously, the heater fire is put out.

Still another object of the present invention is to provide a kerosene supplying device for use in a kerosene heater which is simple, inexpensive and can be readily installed on a used heater.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention provides an automatic device for controlling the supply of fuel to a heater which includes a magnetic device units operatively associated with on/off switches, respectively, and a thermostat operatively connected to the switches, whereby one of the switches is actuated to the off position by the sensing of the thermostat for a period time during a higher room temperature than a predetermined thermostat temperature. Also, when the source of electric power is cut off, the fuel supply is automatically stopped.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
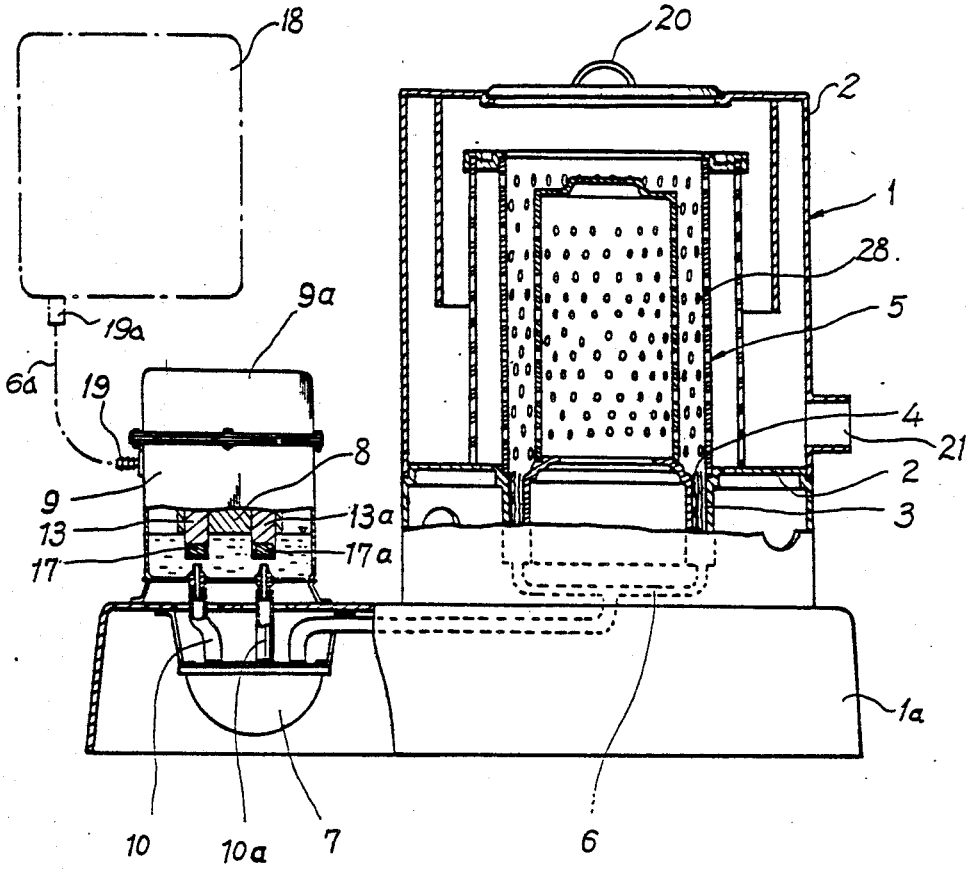
FIG. 1 is a front elevational view of an automatic device for controlling the supply of fuel to a heater showing in cut away portions thereof the basic components of the present invention.
Figure 2:
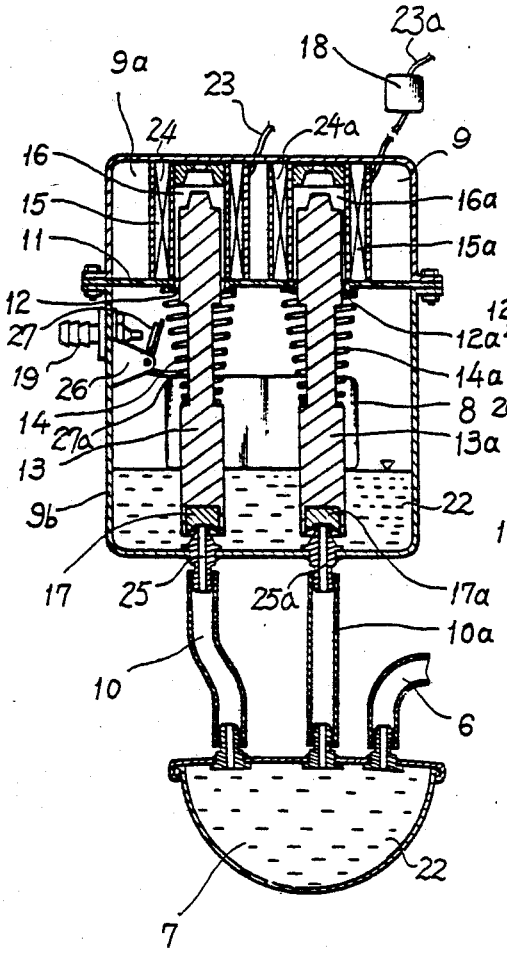
FIG. 2 is a sectional view of an automatic fuel supplier of the present invention showing the off position thereof.

Referring now in detail to the drawings for the purpose of illustrating preferred embodiments of the present invention, the automatic device (9) for controlling the supply of fuel to a heater as shown in FIGS. 1 and 2 includes first and second magnetic units 15 and **15*a*, first and second push rods 13 and 13*a* having on/off switches 17 and 17*a*, respectively a fuel storage tank 7, and first and second conduits 10 and 10*a* connected between the fuel supplying device 9 and the fuel storage tank 7**.

The fuel supplying device 9 includes a cap **9*a* and a body member 9*b*. The device 9 is operatively associated with a heater 1 through a T-shaped supply pipe 6 and a fuel reservoir tank 18 through a drain pipe 6*a* connected between an outlet 19*a* of the reservoir tank 18 and an inlet 19 of the fuel supplying device 9**.

Figure 3:
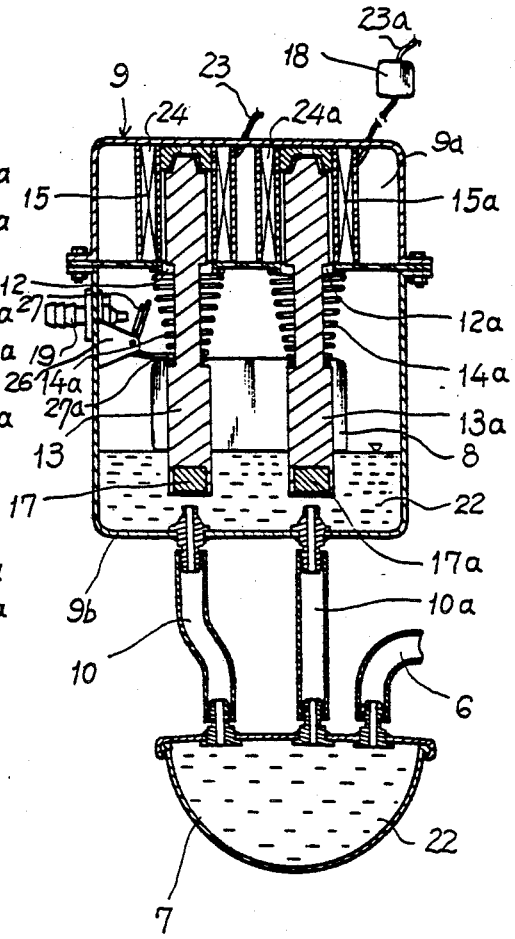
FIG. 3 is a sectional view of an automatic fuel supplier of the present invention showing the on position thereof.

As shown in FIGS. 2 and 3, the magnetic units 15 and **15*a* of the fuel supplying device 9 include first and second cylinders 16 and 16*a* for receiving the push rods 13 and 13*a* and first and second coil spring 14 and 14*a* wound around the push rods 13 and 13*a*, respectively. The magnetic units 15 and 15*a* having first and second magnetic coils 24 and 24*a* are connected to first and second electric wires 23 and 23*a* which are connected to the source of electric power (not shown). Also the magnetic units 15 and 15*a* are placed in the interior of the cap 9*a*. The second electric wire 23*a* has a thermostat 18** for controlling the room temperature.

The body member **9*b* includes a support plate 11 covered thereon. The support plates 11 contains first and second apertures 12 and 12*a* for passing away the first and second push rods 13 and 13*a***, respectively.

Also the body member **9*b* contains fuel 22 such as, for example, kerosene and is provided with a float 8 disposed on the fuel 22 wherein the float 8 is connected to a closure 27 26 through a rope 27*a* pivotally associated with a support 26. The float 8 maintains to equalize the clearance of the fuel 22 in the body member 9*b* with the lower end of a circular wick 4 for continuously supplying a certain amount of fuel to the wick 4 (FIG. 1). When the clearance of the fuel 22 is lower, the closure 27 is opened by the float through the rope 27*a*. The support 26 is mounted to the interior of the body member 9b. Also the body member 9b includes first and second drain holes 25 and 25a for corresponding with the first and second on/off switches 17 and 17a**.

The heater 1 includes a foundation 1a, a combusting device unit 5 having a plurality of apertures 28, the circular wick 4 disposed in a circular slot 3, a housing 2 having a handle 20, and an air inlet 21. The circular slot receiving the wick 4 connects to the T-shaped supply pipe 6 which connects to the fuel storage tank 7.

In operation, when the electric source (not shown) is the on position, the first and second magnetic coils 24 and 24a are actuated to function as a magnet which open the first and second on/off switches 17 and 17a, respectively. And the fuel 22 in the body member 9b drains to the fuel storage tank 7 through the first and second conduits 10 and 10a, respectively. The fuel 22 in the fuel storage tank 7 supplies to the wick 4 in the heater for maintaining the combustion of the fuel 22. Thereafter, if a room temperature is higher than a predetermined temperature of the thermostat 18, the second magnet unit 15a is disconnected to the electric source and the second push rod 13a having the second on/off switch 17a comes down causing the biased force of the second coil spring 14a and moving to the off position so that the fuel 22 in the body member 9b is supplied to the heater 1 through only first drain hole 25 so as to reduce the combustion. Accordingly, when the room temperature is equal with the predetermined temperature of the thermostat 18 the electric circuit is complete so that the second on/off switch 17a opens to supply the large quantity of fuel 22 to the heater 1. Also, when the electric source is at the off position, the magnetic units 15 and 15a are not actuated and the switch 17 and 17a is at the off position, respectively so that the heater 9 automatically puts out the fire. Thus, the present invention provides to reduce the fire disaster causing the prevent of the over-heating of the heater.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An automatic fuel supplying device for use in a heater, which comprises:

a body member having a cap and a support plate disposed between said body member and said cap, said support plate having first and second apertures, first and second push rods passed through said first and second apertures, said first and second push rods being inserted into said first and second magnetic units at one end thereof, first and second on/off switches disposed at the other end of said first and second push rods for being operatively associated with first and second drain holes disposed in the bottom surface said body member, and a fuel storage tank operatively associated with said body member through first and second fuel conduits, whereby, upon the operation of the electric source, the magnetic units are energized causing the pushing rods to fixedly engage with first and second cylinders of the magnetic units and the on/off switches to automatically open, thereby maintaining the fuel supplying action, and upon the sensing of a higher room temperature than a predetermined temperature of a thermostat connected to the second magnet unit, the electric source is disconnected and the second magnetic unit is no longer energized causing the pushing rod to disengage with the second cylinder and the second switch to automatically close, thereby stopping the fuel supplying action so that the heating is reduced and also, when the electric source for the automatic device is at the off position, the magnetic units are no longer energized and the first and second on/off switches close so that the heater automatically puts out the fire.

2. The automatic fuel supplying device of claim 1, wherein the fuel storage tank is provided with a T-shaped fuel pipe for connecting to a wick of the heater.

3. The automatic fuel supplying device of claim 1, wherein the main body is provided with a float disposed on the fuel therein for controlling the clearance of said fuel which is equal with the lower end of the wick in the heater.

4. The automatic fuel supplying device of claim 1, wherein the main body is connected to a fuel reservoir tank through a pair of fuel tubes.

* * * * *